US005987827A

United States Patent [19]

Lord

[11] Patent Number: 5,987,827

[45] Date of Patent: Nov. 23, 1999

[54] CONCRETE BUILDING CONSTRUCTION AND METHOD

[76] Inventor: Ray Lord, 13291 Collecting Canal Rd., Loxahatchee, Fla. 33470

[21] Appl. No.: 08/657,474

[22] Filed: May 29, 1996

[51] Int. Cl.[6] ..... E04B 1/04

[52] U.S. Cl. ..... 52/274; 52/271; 52/284; 52/294; 52/125.1; 52/604; 52/611; 52/125.4; 52/286; 52/589.1

[58] Field of Search ..... 52/611, 610, 609, 52/608, 604, 602, 599, 596, 574, 250, 251, 258, 274, 284, 294, 293.1, 293.2, 125.1, 125.2, 125.3, 125.4, 236.7, 236.8, 270, 271, 286, 293.3, 589.1, 591.4, 591.5, 598, 292, 295, 592.1, 578, 79.9, 79.14

[56] References Cited

U.S. PATENT DOCUMENTS

| | | | |
|---|---|---|---|
| 1,067,792 | 7/1913 | Baron | 52/274 X |
| 1,709,954 | 4/1929 | Saltiel | 52/583.1 |
| 3,685,241 | 8/1972 | Cooper | 52/274 X |
| 3,952,471 | 4/1976 | Mooney | 52/274 X |
| 4,222,208 | 9/1980 | Ferver | 52/169.5 |
| 4,277,921 | 7/1981 | Gianfranco | 52/79.4 |
| 4,901,491 | 2/1990 | Phillips | 52/274 |
| 5,493,838 | 2/1996 | Ross | 52/745.1 |
| 5,761,862 | 6/1998 | Hendershot et al. | 52/79.14 X |

FOREIGN PATENT DOCUMENTS

| | | | |
|---|---|---|---|
| 759688 | 5/1967 | Canada | 52/274 |
| 2248848 | 4/1973 | Germany | 52/79.7 |
| 2221163 | 11/1973 | Germany | 52/274 |
| 58-127835 | 7/1983 | Japan | 52/292 |
| 59-165737 | 9/1984 | Japan | 52/292 |
| 4-5331 | 1/1992 | Japan | 52/292 |
| 5-171655 | 7/1993 | Japan | 52/294 |
| 6-173277 | 6/1994 | Japan | 52/294 |
| 273612 | 7/1927 | United Kingdom | 52/125.4 |
| 2079810 | 1/1982 | United Kingdom | 52/79.13 |

*Primary Examiner*—Laura A. Callo
*Attorney, Agent, or Firm*—Norman Friedland

[57] ABSTRACT

In a building construction individual concrete panels are formed utilizing a horizontal casting platform to tailor the panels to meet structural and aesthetic requirements with each panel having abutting joints that interlock. The method of installing the panels to erect the building is to prepare the strata including a final layer of mixed sand and stone, wetting the surface, erecting the panels in position and temporarily bracing them and vibrating the strata, attaching the adjacent panels and removing the bracing. The panels are individually molded with a interlocking base on a planar horizontal table including the form edges that are oriented to define the configuration of the panels.

2 Claims, 5 Drawing Sheets

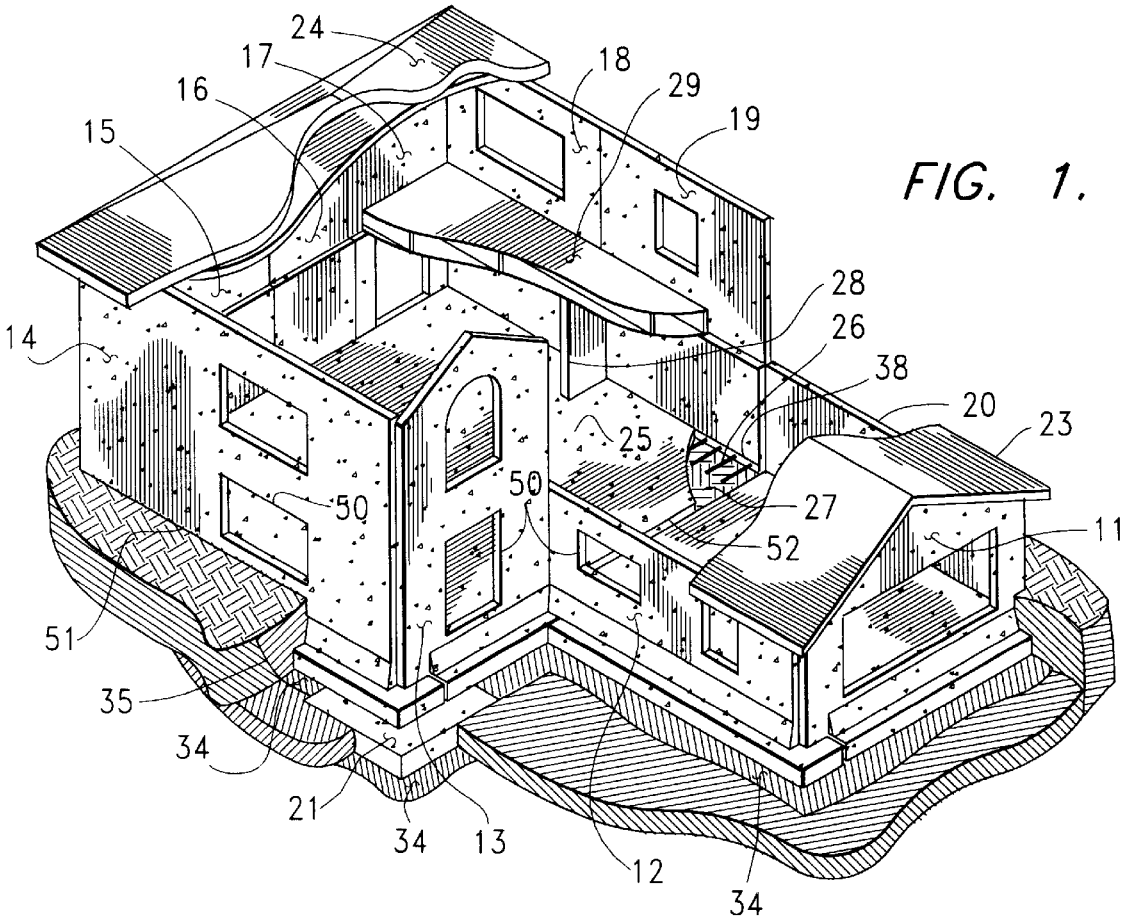
FIG. 1.
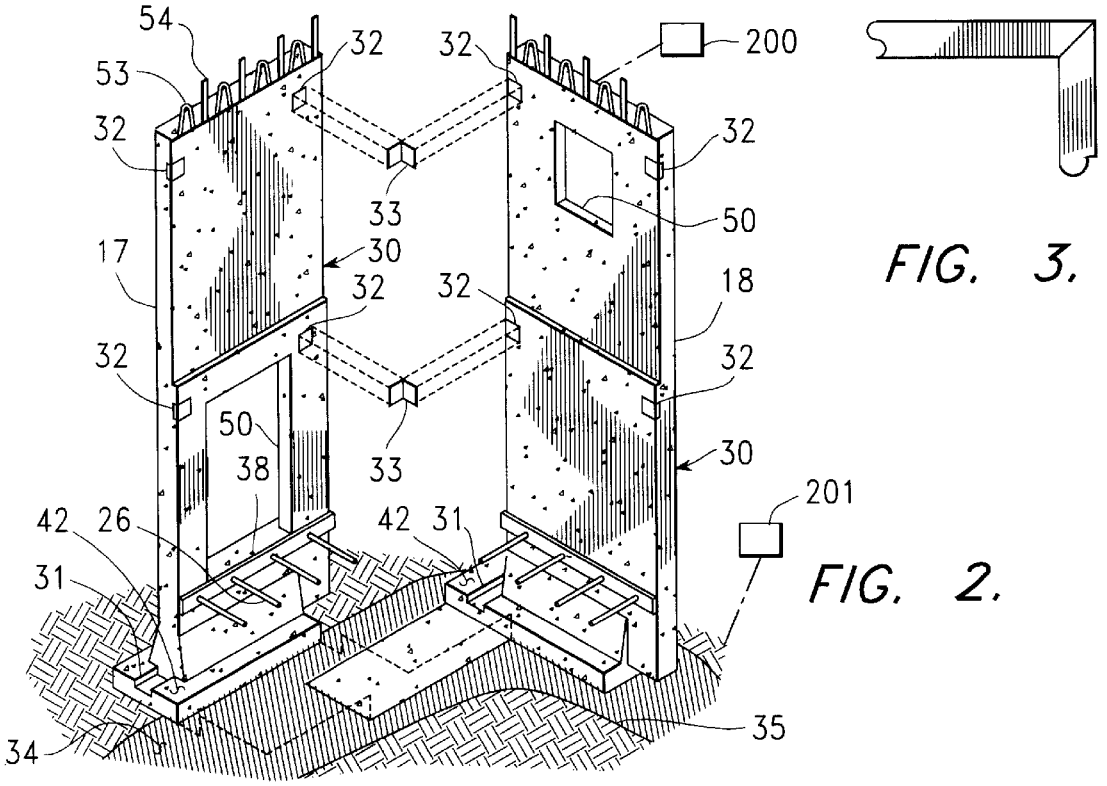
FIG. 3.
FIG. 2.

CONCRETE BUILDING CONSTRUCTION AND METHOD

TECHNICAL FIELD

This invention relates to preformed reinforced concrete wall units and particularly to a reinforced concrete wall unit having a unitary interlocking base or pedestal, the method of manufacturing each of the reinforced concrete wall units into individually molded units to meet a specific design criteria with reusable casting beds forms, and the method of construction of the building utilizing these reinforced concrete wall units.

BACKGROUND ART

As is well known in the building industry, those skilled in this art have attempted to produce a structural concrete wall system that would be competitive with composite masonry or wood frame construction. Such systems have never attained complete acceptance because they either lacked sufficient design flexibility or that they are not economically competitive. An example of prior art structural concrete wall system is exemplified in U.S. Pat. No. 4,901,491 granted to Phillips on Feb. 20, 1990 and entitled "Concrete Building Construction". As noted in this patent, the walls formed by generally planar concrete wall panels are affixed to concrete corner posts, and the panels include enlarged footers that rests on an underlying ground surface. A complex metal strap connection structure is employed to attach the panels and erect the building. This construction, is not only uneconomical, but is complex in its design, construction and assembly. Other systems form the exterior load bearing walls of the one or two story buildings by utilizing a series of planar shaped wall segments of various sizes butting end-to-end to form a three dimensional polygon. These systems leave something to be desired particularly in view of the fact they lack sufficient design flexibility and/or are not cost effective.

I have found that I can obviate the problems of the heretofore known reinforced concrete building constructions by providing a single precast concrete wall unit with an integral base that is self-sustaining in the vertical position while replacing the four separate elements in these conventional wall building processes which are, namely the concrete foundation, the masonry wall, the tie beams and columns and the stucco finish. In accordance with my invention each single wall unit would be individually designed and engineered to perform its intended function of defining the aesthetics of the building, forming a viable load bearing wall system, and attaining an economical building that is easier to assemble resulting in simplifying the erection of the building and reducing construction time.

Each concrete wall is individually designed utilizing for the most part reusable casting forms that allow for the casting on site or at a remote location.

SUMMARY OF THE INVENTION

An object of this invention is to provide an improved precast reinforced concrete wall that is characterized as being relatively inexpensive to fabricate, can be manufactured to a higher degree of precision than heretofore known precast walls, and have structural and aesthetic design flexibility.

A feature of this invention is that the use of the precast concrete walls facilitates, reduces the cost, and expedites the erection of a building.

A feature of this invention is that each of the reinforced concrete wall units has an integrally formed base allowing each wall unit to be self-sustaining in the vertical position and carries an interlocking design that interlocks the adjacent reinforced concrete wall units.

The method of construction of the individual wall units includes the steps of forming a mold on a planar horizontal table that conforms to the dimensions and design of the individual walls by utilizing edge forms to dimension the outer edges of the panel and interior edges of the individual cut-outs for windows, doors and the like. One end of the table includes forms defining a well and forms for defining integrally formed base. The forms are laid out horizontally and the liquid concrete is poured between the form edges. The reinforcing metal rods and support members are positioned to structural support the concrete and allow for carrying the wall to its building cite and to secure adjacent walls.

Prior to the installation of the wall units at the site the bearing strata is brought to the precise desired elevation and density and a thin mixture of sand and crushed stone is applied to construct the final smooth level and flat bearing surface for the wall units. After the bearing surface is constructed it is thoroughly wetted to facilitate the installation ("seating") of the wall units.

The integral base supports each wall unit vertically. Since the unattached walls may not align correctly due to manufacturing and construction tolerances the walls are held in the aligned position and the bearing surface is vibrated which will cause the walls to be permanently aligned relative to each other or be seated and thereafter fastened.

The foregoing and other features of the present invention will become more apparent from the following description and accompanying drawings.

BRIEF DESCRIPTION OF DRAWINGS

FIG. 1 is a view in perspective illustrating the invention being utilized in a one and two story building;

FIG. 2 is an exploded view in perspective illustrating a pair of corner precast reinforced concrete panels;

FIG. 3 portrays a mitered corner;

DETAILED DESCRIPTION OF THE PREFERRED EMBODIMENT

Figure 4:
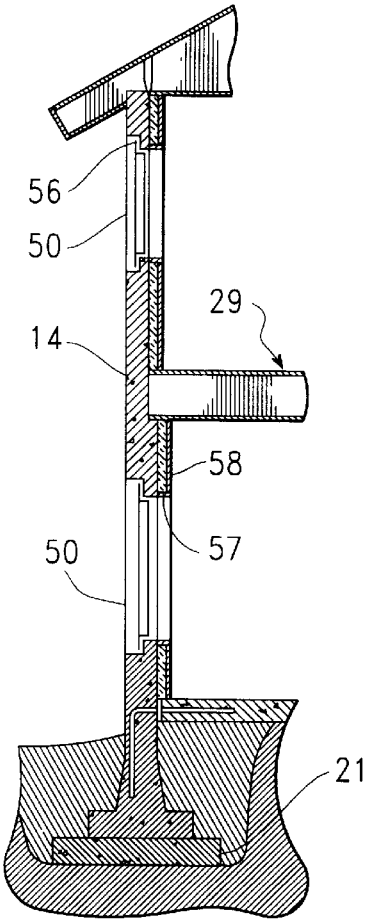
FIG. 4 is a view in cross section illustrating a two story panel.

As will be appreciated by one skilled in this art the preferred embodiment describes the inventive wall units or panels utilized to erect a building and that the panels have infinite utility in constructing buildings where it is desirable to fabricate the building to meet different aesthetic designs. As will be appreciated from the perspective view of FIG. 1 panels 11, 12, 13, 14, 15, 16, 17, 18, 19 and 20 are illustrative of the many panel designs capable of being prefabricated in reinforced concrete panels of this invention. While each panel has similar characteristics, it will be appreciated that this is not a modular system notwithstanding that each individual wall unit is made from a common forming technique which will be described in more detail hereinbelow.

In the event the uplift or point loading exceeds the capacity of the soil conditions or foundation section of the wall unit, an additional precast pad 21 may be utilized. In FIG. 1 the assembled precast concrete wall units can be utilized to support a typical gable end type of roof structure 23 or a typical hip type roof structure 24, as will be explained in further detail hereinbelow. Lateral stability reinforced rods 26 will be embedded into the wall unit to attach the units to the four (4) inch poured in place interior floor slab which is placed after the erection of the wall units. As is well known the slab rests on compacted fill 27. A typical interior dry wall room partition 28 is also shown. To best utilize the building system of this invention, the individual precast wall units should meet at these locations wherever possible. When the building has a second story structure a composite second floor deck 29 could be partially or totally supported by the exterior walls. The integral expansion joint 38 at the interior floor slab elevation is shown.

Also shown in FIG. 1 are the window and door openings 50, the prepared grade 34, the excavation cut 35 exterior grade 51 and the garage step down 52, which will be described in further detail hereinbelow.

As shown in FIG. 2 the base of the concrete wall units 17 and 18 are preformed with off-sets that may include slots 31 which serve to support the next adjacent panel. As noted panel 17 includes the leading edge off-set 30 that fits into slot 31 and rests on the off set foundation section 42 of panel 18. In order to complete the perimeter of the building structure, the first wall unit will have both a trailing off set foundation section 42 and a leading edge off-set foundation section 42 and will not have a leading edge off-set 30, and the last wall unit will have both a leading edge off-set 30 and a trailing edge off-set 30 and will not have an off-set foundation section 42. In other words the end panels will have the projection off-set 42 on both edges of one of the panels and a leading edge off-set (recess) on both edges on the other of the perimeter with the panel 149 having a pair of off-set foundation sections 42, panel 151 includes opposing leading edges 30 and the interlocking portion of panel 153 is identical to the other panels as described in FIG. 1.

While square corners are shown in the preferred embodiment, it will be appreciated that the corners may be mitered as shown in FIG. 3. In the erection of the building the base sections of the panels 17 and 18 rest on a carefully prepared grade 34 which may consist of the natural soil conditions brought to within minus one half inch of the desired elevation. The excavation cut 35 should be wide enough to accept the base section of the wall unit plus enough room to accommodate the vibrating mechanism, compacted and stabilized to the required design specification. The remaining one half inch of bearing strata should consist of a mixture of rock screening and sand which will be placed on the previously prepared surface and graded to the precise required elevation.

Prior to placing precast concrete wall units, the prepared grade is thoroughly wetted. The wall units such as 17 and 18 are then carefully placed into position by use of a crane, that lifts the precast panel by the use of lifting brackets 53. As is the situation with most constructions due to manufacturing tolerances and/or unevenness of the grade the wall units will tend to be unaligned. To overcome these small deviations from the vertical and in accordance with one aspect of this invention this problem is corrected by the temporary use of a commercially available suitable bracing arm 200 (shown in phantom). The wall units are then temporarily braced in a satisfactory position and a commercially available vibrating mechanism 201 is applied to the grade. The vibrations will cause the wall unit to seat itself in the grade and assure satisfactory contact between the supporting grade and the base element of the wall unit. Once the bracing arms 201 are removed and the panels will remain in the correct position, the clip angles 33 are welded to the embedded welding plates 32 and the void between slot 31 and leading edge 30 is filled with a non shrink grout.

The two story precast wall unit 14 shown in FIG. 1 is shown in cross section in FIG. 4 and also shows the window and door openings 50 with integral concrete mounting "bucks" 56. The furring strips 57 which would be applied to the interior faces of the interior of the panels serve to support the topical drywall finish 58.

Figure 5:
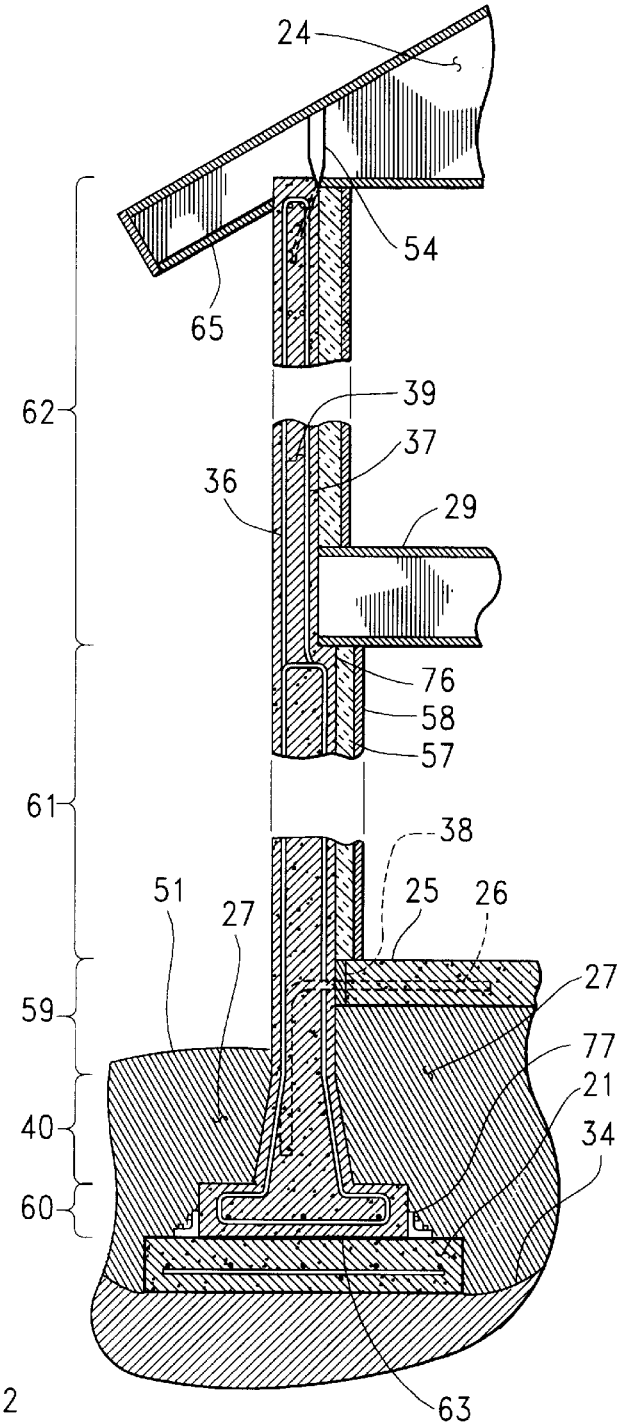
FIG. 5 is a partial view in section showing the details of the wall unit foundation section supported on an additional concrete pad for point loading or uplift.

The foundation section of the two story wall unit 14 is detailed in FIG. 5. When the point loading or up lift exceed the capacities of the foundation section 60 of wall unit an additional precast pad 21 can be placed prior to the wall unit being erected into place. Pad 21 would be placed in the same manner as a wall unit as previously described. The top of the pad would be one half inch below the elevation 34 required for the wall unit. The wall unit 14 would then be placed on prepared grade 34 at the higher elevation and on a bed of grout 63. The foundation section 60 would then be bolted to the foundation pad 21 via wedge anchors 77 or the like. As previously mentioned, the wall unit will be vertically stable in and of itself, due to the integral base. Obviously, the successive panels once erected will add to the stability of all the other panels. Additional support will be had as a result of the back fill 27 in preparation for the interior slab and the exterior grade 51, the embedding of the lateral stability reinforcing rods 26 in the interior slab 25 and the proper application of a second floor 29 (FIG. 5) or roof 24.

Additionally and as shown in FIG. 5 is the tapered section 40 which will help to spread the downward load to the base section 60 of the panels. This tapered section will also serve to better accommodate the transition of the reinforcing in this area. The tapering of the forms in the manufacturing process as will be shown in detail hereinbelow, will act as a restriction nozzle for the liquid concrete and allow the wall unit to be cast as one piece. The portion of the panel section 59 elevation transition section of the wall unit will allow for the change in elevation of the floor slabs in the assembled structure. This is the area through which the lateral stability reinforcing rods 26 project from the wall unit through the integral expansion joint 38 into the interior slab. The importance of this area in the manufacturing process will be explained hereinbelow.

As is apparent from the foregoing, the size and reinforcing of each panel would be dictated by the structural and architectural demands placed on them. However, it is the teachings of this invention to have the reinforcing divided into two mats, an interior mat 37 and exterior mat 36. The purpose of this is to create a chase area 39 in the panel section 61 and 62 in which electrical conduits and the like can be placed.

FIG. 5 shows how the second floor panel section 62 could become proportionally thinner due to the decreased loading. Also it is generally beneficial to have a ledger 76 to support the second floor system. FIG. 5 also illustrates the truss strap 54 which is utilized to attach the trusses to the wall units. Like the weld plate 32 (FIG. 8), the truss straps are preferably located in the beam area 64 of the wall units and are imbedded therein so that the truss strap 54 will protrude out of the top of the panel on the interior side thereof. While the soffit area 65 on the underneath side of the roof typically is covered with a stucco material, other commercially available materials such as ventilated aluminum or vinyl could be utilized.

Figure 6:
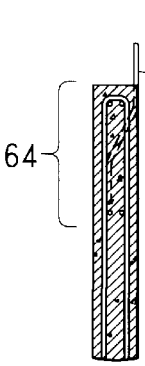
FIG. 6 is a partial view in section illustrating the imbedded lifting brackets in the panel.
Figure 7:
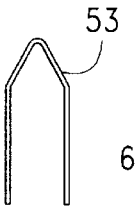
FIG. 7 is a view of a lifting bracket.

FIG. 6 shows how lifting brackets 53 (FIG. 7) suitably made form reinforcing rods, would be placed in the beam area 64 of the pane section. The bracket would protrude out the top of the interior face side of the panel. The purpose for this location being to lessen the likelihood of chipping the exposed face of the panel. The location of the bracket is also important in the manufacturing process as will be explained hereinbelow.

Figure 8:
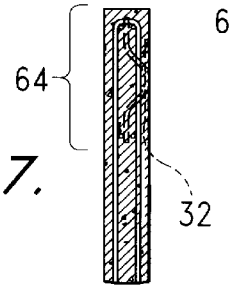
FIG. 8 is a partial view in section illustrating the welding plates embedded in the panel.

As can be seen in FIG. 8 the weld plate 32 is imbedded into the wall unit. It will be noted that the weld plate is shown in relation to the beam area 64.

Figure 9:
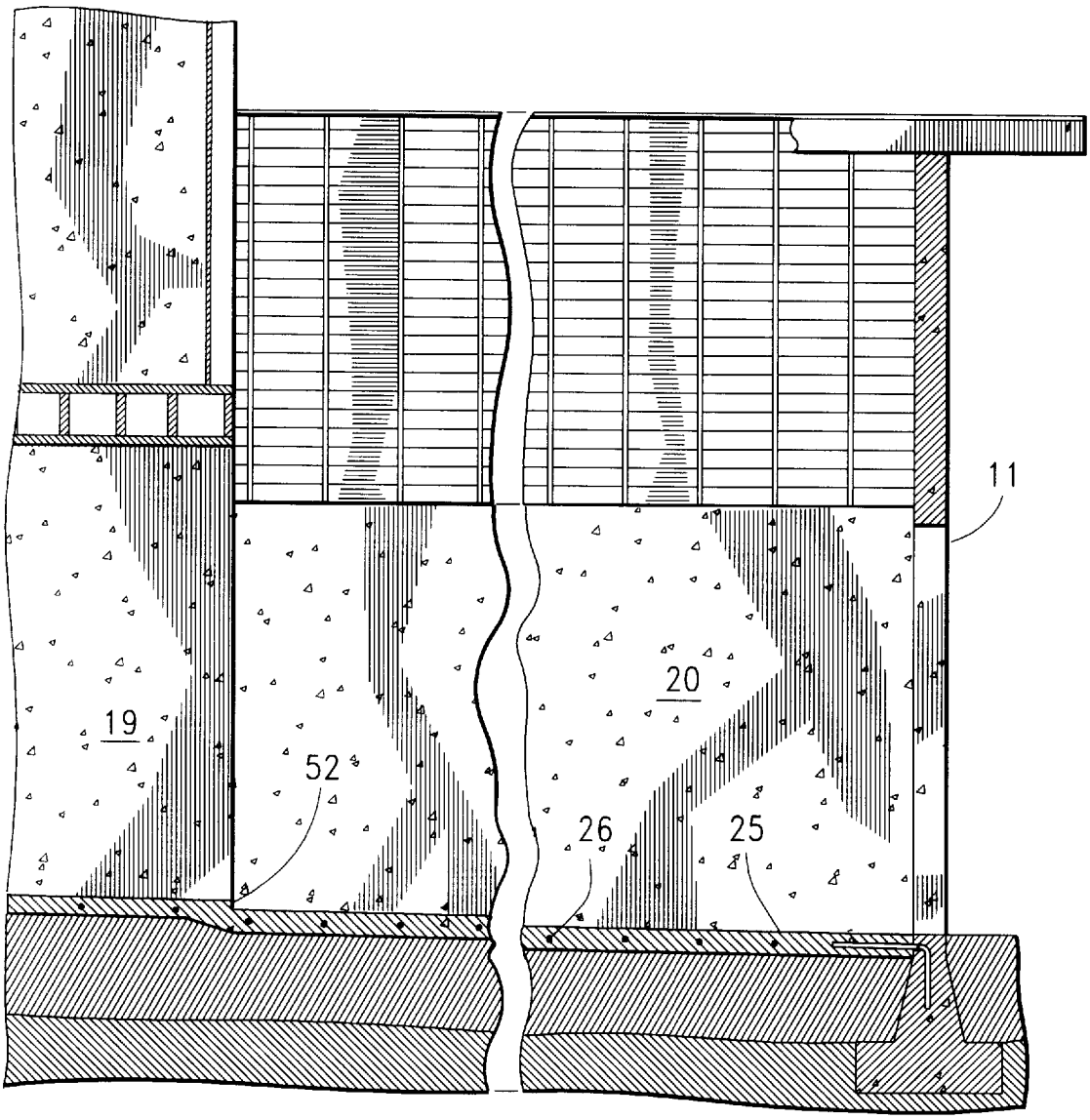
FIG. 9 is a view in elevation of a garage unit and gable end section illustrating how the wall unit can accommodate a recessed or sloping garage floor.

In certain buildings changes in floor elevations may be desired. For example, the floor on the garage may need to be sloped or a room in the building may be sunken. FIG. 9 is illustrative of such a construction and is shown in the elevation of wall unit 20 with a cross section of the gable end wall unit 11. The elevation of wall unit 20 demonstrates how the wall unit can adjust to changes in elevation of the slab level 25 by adjusting the location of the lateral stability reinforcing rods 26. FIG. 9 illustrates a typical 4 inch garage floor drop down 52 and a sloping floor.

Figure 10:
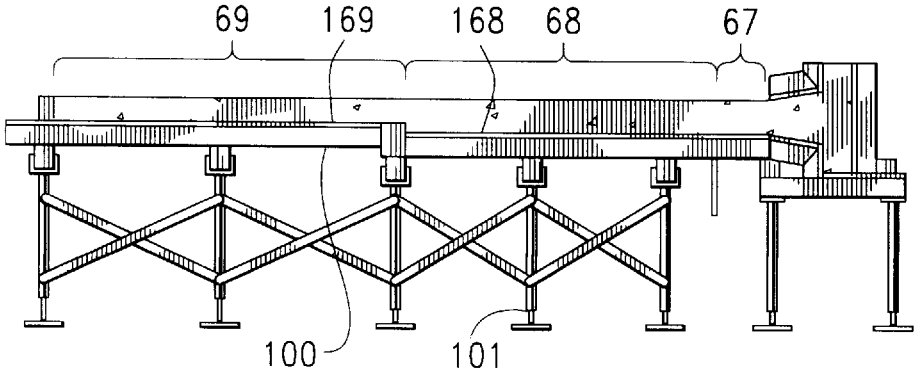
FIG. 10 is a view in section illustrating the horizontal table and forms for casting a two story panel.
Figure 11:
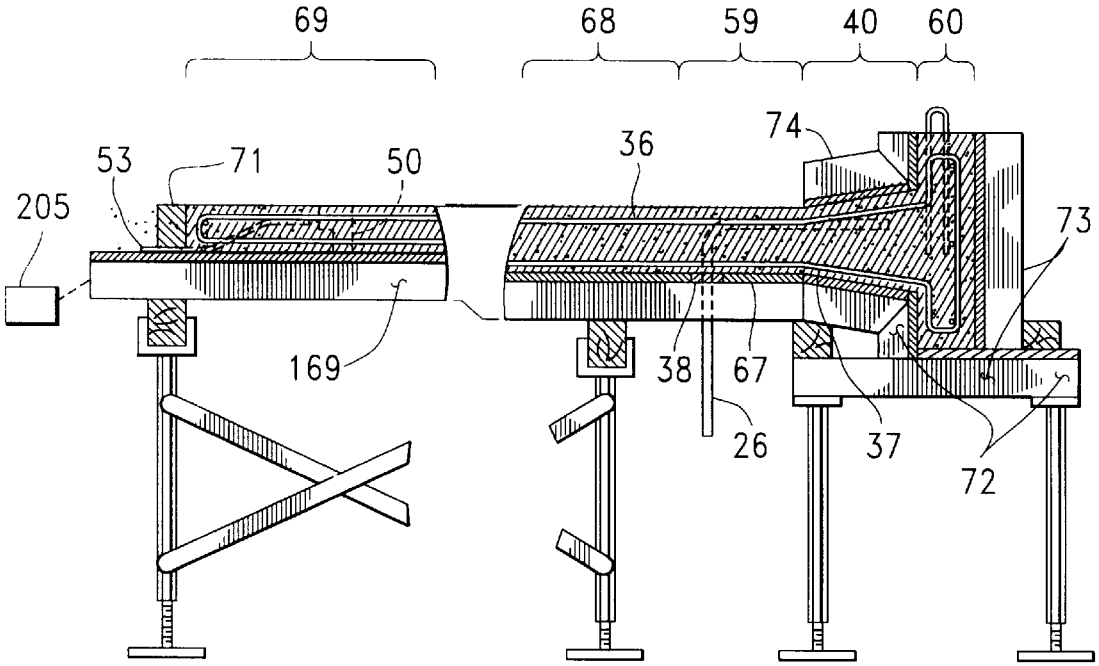
FIG. 11 is a partial enlarged view in section showing the forms for casting the wall unit.

The forms required to cast the concrete wall units and casting bed are shown in FIG. 10. and will now be described. As noted the casting bed generally indicated by reference numeral 100 is portable and can be used on sight or in a remote location as in a factory or the like and it is formed from several elements. As shown in FIG. 10, the bed 100 is rigged for a two-story building as depicted by portions 67, 68 and 69 referred to as main bed 68, elevation transition element 67 and extension bed 69. Main bed 68 , sacrificial bed 67 and extension bed 69 each have a horizontal flat table top 168 and 169 with a planar surface. The beds are supported to a scaffold type construction supported with adjustable legs 101. The table and forms are made from any suitable wood and the table top would preferably be of plywood. As shown in FIG. 11, whether the beds are utilized for a single story building depicted by main bed 68 or a two-story building as depicted by extension bed 69 the desired wall unit will have the unitary base 60 integrally cast therein.

The forms are constructed by boards such as 2×4's and would include the top and opposing side edges that define the overall dimension of the wall unit which in this instance is rectangular in shape. The bottom portion of the wall unit will be defined by the wooden forms depicted in FIG. 11. As was explained previously (and as is shown in FIG. 11) lifting brackets 53 and truss straps 54 protrude from the wall unit on the interior face, allowing the edge form 71 to pass over, thus defining the perimeter of the wall unit without customized alteration of the edge form 71.

Figure 12:
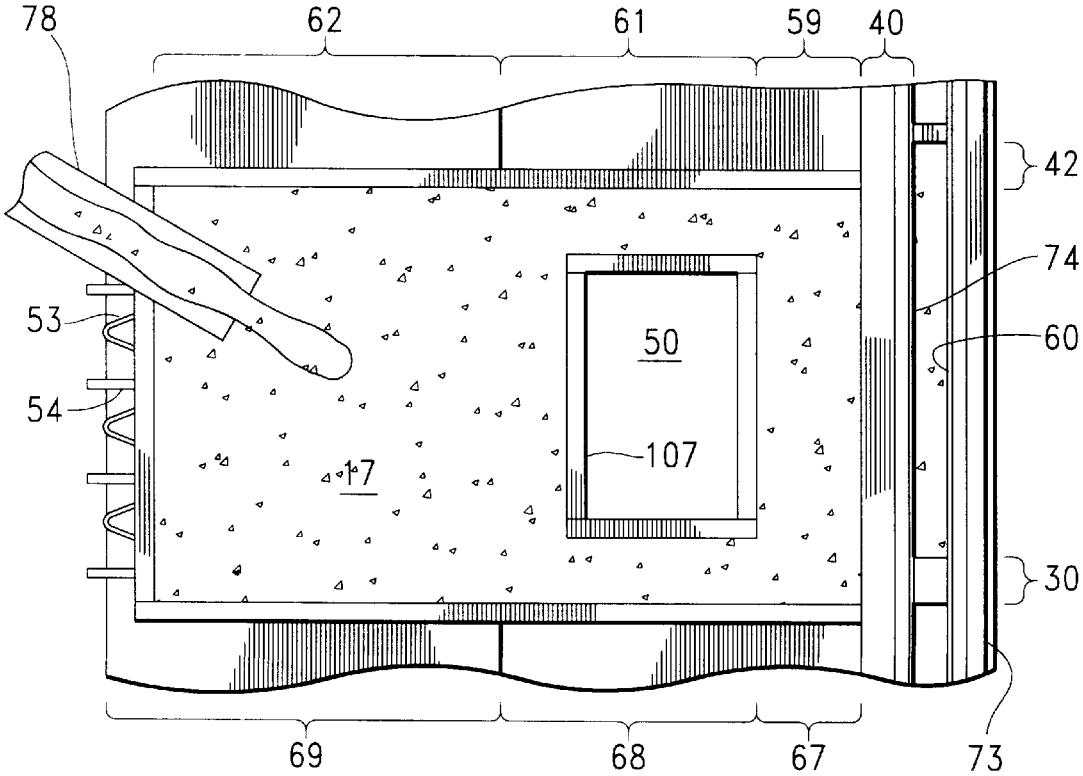
FIG. 12 is a view in plan showing how a concrete wall unit would be formed on a two story casting bed.
Figure 13:
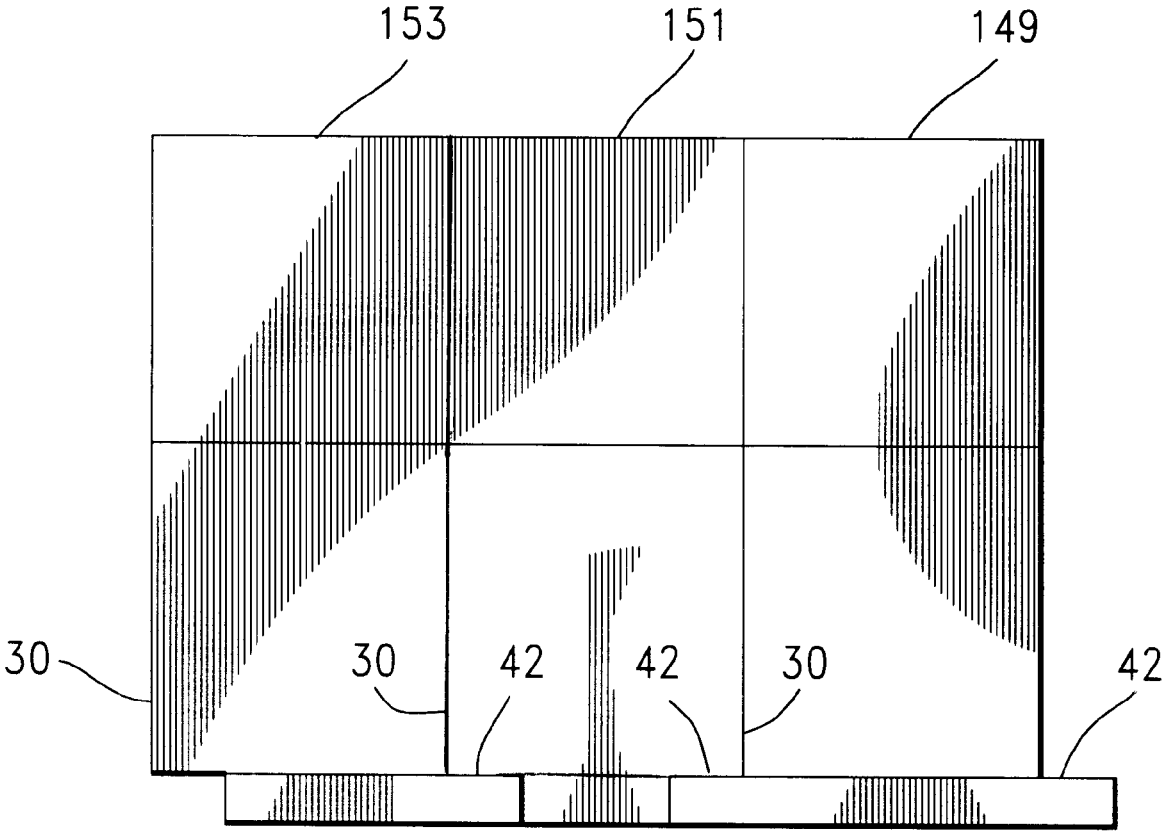
FIG. 13 is a schematic view in elevation showing the final panel interlocking configuration to complete the periphery of the building.

Within the outer edge forms that define the outer edges of the wall units and its generally rectangular shape as shown in FIG. 12, the forms that define the cutouts that are used for the doors and windows are placed in locations within the outer edge forms as desired. Obviously, these forms (as are the beds) are reusable and can be utilized over and over for other wall units. As noted, window form 107 defining the top of window 50 would be placed on the horizontal table top 169 103 in the desired position. The opposing side edge and bottom edge forms would likewise be placed and attached to the various beds.

As is apparent from the foregoing, there is an enormous amount of latitude of locating the forms on the beds and the wall units can take almost any shape to meet the desired requirements. This gives the architect or builder tremendous amount of options to design the building in the manner best suited for his needs.

The enlarged view of FIG. 11 illustrates the bottom portion of the wall unit and particularly the forms for casting the base. Also illustrated is the elevation transition portion of the bed 67 which is useful in the event a sloped floor or sunken room is desired. The lateral stability rods pass through the integral expansion joint 38 which defines the slope or elevation of the sunken room or the garage floor, so that the cast wall unit would include the lateral stability rods protruding at the proper elevation to attach the wall units to the floor slab.

An important aspect of this invention is the casting of the base section of the wall unit which is generally depicted by reference numerals 72, 73 and 74. As noted the form 72 is displaced vertically from the interior face of the wall unit and extends perpendicularly for the distance necessary to define the width of the base. The form 73 defines a rectangular shaped cavity and the sloping forms 72 and 74 define a nozzle for restricting the flow of concrete out of the cavity. The top the base forms is open allowing for the introduction of the concrete.

The method of manufacturing the wall unit comprises the following steps:

1) Assemble the casting bed elements such as beds 68, 69 etc.;
2) Lay out panel-edge forms 71 and the forms defining the openings for window, door or the like on the beds, include the truss straps, lifting brackets, welding plates, etc on the bed;
3) Insert first mat of reinforcing 37 and lateral stability rods 26;
4) Install electrical conduits, if required;
5) Drop in second mat of reinforcing 36;
6) Secure second foundation section form 74 in place;
7) Pour from the top of the beds liquid concrete into the space between the edge forms using any of the commercially available traveling vibrating leveling mechanisms shown as blank 205;

The vibrating leveling mechanism passes over the concrete filled form assuring that the form is completely filled and all the honeycomb is removed and the exposed surface is flat and even;

8) A water mist is immediately applied to the exposed surface of the concrete;
9) A dry 50—50 mixture of sand and cement is broadcast on the surface of the concrete before it dries; This dry mixture can be dispersed in many different ways to produce the finish desired. This surface is then worked mechanically by use of trowels and other well known suitable tools to produce the results desired;
10) Once the concrete is cured to the degree of hardness desired, the forms are stripped and the cast wall unit is removed from the bed to be used in the erection of the desired building.

I claim:

1. A plurality of cast planar wall units each of which are adapted to be placed end-to-end adjacent to other cast planar wall units of said plurality of cast planar wall units to define the walls of a building and being made from concrete, each of said wall units being generally rectangularly shaped having a top, opposing sides defining a leading edge and trailing edge, a bottom, an interior face, an exterior face, and a base integrally formed on the bottom, said base supporting said wall unit in an upright position when placed on the ground, said base extending beyond said exterior face and said interior face, at least one of said wall units having its base extending beyond its trailing edge, at least another of said wall units having its leading edge extending beyond its base and at least one of said wall units having its leading edge and its trailing edge extending beyond said base, and a transition section between said base and said interior face and said base and said exterior face of each of said planar wall unit where the thickness of said transition section fairs to a thicker portion at said base.

2. A cast planar starter wall unit made from concrete adapted to be placed adjacent to other cast planar wall units made from concrete to smart the planar wall units for defining the walls of a building and being made from concrete, said wall unit being generally rectangularly shaped having a top, opposing sides defining a trailing edge and a leading edge, a bottom, an interior face, an exterior face, a width of the rectangularly shaped wall unit between the interior face and the exterior face being less than a length of the rectangularly shaped wall unit between the leading edge and the trailing edge, a base integrally formed on the bottom, said base supporting said wall unit in an upright position when placed on the ground, said base extending beyond said exterior face and said interior face, said base extending beyond said leading edge and said trailing edge, said trailing edge and said leading edge adapted to abut the leading edge and trailing edge of the next adjacent wall units and a transition section between said base and said interior face and said base and said exterior face of said planer wall unit wherein the thickness of said transition section fairs to a thicker portion at said base.

* * * * *